US005888955A

United States Patent [19]

Foley et al.

[11] Patent Number: 5,888,955

[45] **Date of Patent: *Mar. 30, 1999**

[54] LIQUID DISHWASHING DETERGENT COMPOSITIONS

[75] Inventors: Peter Robert Foley, Newcastle upon Tyne, Great Britain; Joanna Margaret Clarke, Brussels, Belgium; Yi-Chang Fu, Cincinnati; Phillip Kyle Vinson, Fairfield, both of Ohio

[73] Assignee: The Procter & Gamble Company, Cincinnati, Ohio

[ * ] Notice: The term of this patent shall not extend beyond the expiration date of Pat. No. 5,534,197.

[21] Appl. No.: 669,545

[22] PCT Filed: Jan. 20, 1995

[86] PCT No.: PCT/US95/00768

§ 371 Date: Feb. 4, 1997

§ 102(e) Date: Feb. 4, 1997

[87] PCT Pub. No.: WO95/20026

PCT Pub. Date: Jul. 27, 1995

[30] Foreign Application Priority Data

Dec. 22, 1994 [GB] United Kingdom ..... 9425942

[51] Int. Cl.[6] ..... C11D 3/32

[52] U.S. Cl. ..... 510/235; 510/237; 510/221; 510/433; 510/437; 510/491; 510/502; 510/503; 510/504

[58] Field of Search ..... 510/221, 235, 510/237, 423, 433, 437, 491, 502, 503, 504

[56] References Cited

U.S. PATENT DOCUMENTS

| | | | |
|---|---|---|---|
| 4,255,294 | 3/1981 | Rudy et al. | 252/524 |
| 5,112,688 | 5/1992 | Michael | 428/402.2 |
| 5,223,179 | 6/1993 | Connor et al. | 252/548 |
| 5,236,615 | 8/1993 | Trinh et al. | 252/174.11 |
| 5,512,699 | 4/1996 | Connor et al. | 564/153 |
| 5,534,197 | 7/1996 | Scheibel et al. | 510/356 |
| 5,669,984 | 9/1997 | Scheibel et al. | 134/25.2 |

FOREIGN PATENT DOCUMENTS

| | | |
|---|---|---|
| 0258500 | 3/1988 | European Pat. Off. . |
| 92/06154 | 4/1992 | WIPO . |

*Primary Examiner*—Paul Lieberman
*Assistant Examiner*—Lorna M. Douyon
*Attorney, Agent, or Firm*—Jacobus C. Rasser; Ken K. Patel; Pankaj M. Khosla

[57] ABSTRACT

Liquid dishwashing detergent compositions comprising a co-surfactant selected from amine oxides, betaines, branched alkyl carboxylates and non bridged polyhydroxy fatty acid amides. The dishwashing composition further comprises a bridged polyhydroxy fatty acid amide for improved sudsing performance.

19 Claims, No Drawings

LIQUID DISHWASHING DETERGENT COMPOSITIONS

TECHNICAL FIELD OF THE INVENTION

The present invention relates to liquid detergent compositions, particularly to dishwashing compositions comprising a bridged polyhydroxy fatty acid amide which exhibit improved sudsing.

BACKGROUND OF THE INVENTION

The formulator of a manual dishwashing detergent composition is required to formulate compositions which meet a number of consumer relevant performance demands.

Firstly, such a composition should be effective at removing soils from dirty "dishes" when used in a manual dishwashing process. The soils encountered in dishwashing are largely but not exclusively food based. Particularly difficult soils to remove include greasy soils, burnt-or baked-on soils or those which have been allowed to harden onto the dish article, as well as non-food soils such as lipstick on the rims of glasses or nicotine stains.

Once the soils have been removed from the dishes the dishwashing detergent should act so as to suspend these soils in the wash solution and thus prevent their redeposition onto the dishes, or onto the surface of the sink.

In addition, the manual dishwashing composition should be high sudsing and the sudsing should persist throughout the washing process. This is particularly important as sudsing is used as an indicator by the consumer of the performance of the detergent composition. Moreover, the consumer also uses the sudsing profile as an indicator that the wash solution still contains active detergent ingredients and the consumer usually renews the wash solution when the sudsing subsides. Thus, a low sudsing formulation will tend to be replaced by the consumer more frequently than is necessary because of the low sudsing level.

The manual dishwashing composition should also be mild to the skin, and particularly to the hands and should not cause skin dryness, chapping or roughness. Such skin complaints largely result from the removal of natural oils from the skin. Thus, the manual dishwashing composition should desirably be effective at removing grease from plates but not natural oils from the skin.

In order to address the consumer demand for effective removal of soils found in a dishwashing load, particularly greasy soils, liquid detergent compositions may comprise certain co-surfactants such as long chain amine oxides, betaines, non-bridged polyhydroxy fatty acid amides and branched alkyl carboxylates, which have been found particularly effective in the removal of such soils, especially when present in high concentrations. However, a disadvantage of such compounds is their tendency to reduce the overall sudsing profile of the detergent composition.

Thus, it is an aim of the present invention to formulate a dishwashing composition which facilitates the removal of soils, especially oily and greasy soils and which produces a high and persistent level of sudsing.

It has now been found that this objective can be achieved by the incorporation of certain bridged polyhydroxy fatty acid amides into liquid dishwashing detergent compositions comprising long chain amine oxides, betaines, polyhydroxy-fatty acid amides, alkyl carboxylates or mixtures thereof. Furthermore, an additional advantage of the present invention is that the suds level produced by the addition of the bridged polyhydroxy fatty acid amides is greater than the sudsing produced by conventional suds boosters such as shorter chain length amine oxides.

Polyhydroxy fatty acid amides have been disclosed as surfactants in the art, see for example U.S. Pat. No. 5,194,639, U.S. Pat. No. 5,174,927 and U.S. Pat. No. 5,188,769.

SUMMARY OF THE INVENTION

The present invention is a liquid dishwashing detergent composition comprising at least 1% of a surfactant system, said system comprising a polyhydroxy fatty acid amide, characterised in that said system comprises a) a polyhydroxy fatty acid amide according to the formula:

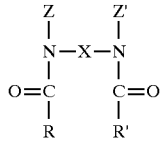

wherein X is a bridging group having from 2 to 200 atoms; Z and Z' are the same or different alcohol-containing moieties having two or more hydroxyl groups, or one of Z or Z' is hydrogen; and R and R' are the same or different hydrocarbyl moieties having from 1 to 21 carbon atoms and can be saturated, branched or unsaturated and mixtures thereof and b) a co-surfactant selected from $C_{16}$ to $C_{18}$ amine oxides, $C_{10}$—$C_{16}$ branched alkyl carboxylates, $C_6$—$C_{18}$ betaines and non bridged polyhydroxy fatty acid amides and mixtures thereof.

All weights, ratios and percentages are given as a % weight of the total composition unless otherwise stated.

DETAILED DESCRIPTION OF THE INVENTION

The present invention is a liquid dishwashing detergent composition comprising at least 1%, preferably from 10% to 60%, more preferably from 20% to 50% of a surfactant system. According to the present invention, the surfactant system comprises as an essential component a co-surfactant selected from $C_{16}$ to $C_{18}$ amine oxides, $C_{10}$–$C_{16}$ branched alkyl carboxylates $C_6$–$C_{18}$ betaines and non bridged polyhydroxy fatty acid amides and mixtures thereof. Preferably the compositions of the present invention comprise from 0.1% to 40%, preferably from 1% to 10%, most preferably from 2% to 8% of said co-surfactant.

Amine oxide surfactant

According to the present invention amine oxides suitable for use herein have the formula:

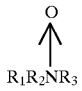

wherein $R_1$ is selected from an alkyl, hydroxyalkyl, acylamidopropyl and alkyl phenyl group, or mixtures thereof, containing from 16 to 18 carbon atoms; and $R_2$ and $R_3$ are independently $C_{1-3}$ alkyl or $C_{2-3}$ hydroxyalkyl groups, or a polyethylene oxide group containing from 1 to 3, preferably 1, ethylene oxide groups. These amine oxide surfactants in particular include $C_{16}$–$C_{18}$ alkyl dimethyl amine oxides and $C_{16}$–$C_{18}$ alkoxy ethyl dihydroxyethyl amine oxides.

According to the present invention the compositions comprise from 0.1% to 20%, preferably from 0.5% to 10%, most preferably from 1% to 5% of said amine oxide.

Alkyl carboxylate surfactant

Alkyl carboxylates useful herein are those which contain a carboxyl unit connected to a secondary carbon. It is to be understood herein that the secondary carbon can be in a ring structure, e.g. as in p-octyl benzoic acid, or as in alkyl-substituted cyclohexyl carboxylates. These surfactants should contain no ether linkages, no ester linkages and no hydroxyl groups. There should be no nitrogen atoms in the head-group (amphiphilic portion). The alkyl carboxylate surfactants usually contain 11–15, preferably from 11 to 13 total carbon atoms, although slightly more (e.g., up to 16) can be tolerated; e.g. p-octyl benzoic acid.

A highly preferred class of alkylcarboxylates comprises the secondary carboxyl materials of the formula $R^3$ $CH(R^4)$ COOM, wherein $R^3$ is $CH_3(CH_2)x$ and $R^4$ is $CH_3(CH_2)y$, wherein y can be O or an integer from 1 to 4, x is an integer from 4 to 10 and the sum of (x+y) is 6–14, preferably 7–13, most preferably 8–10.

Another class of alkylcarboxylate soaps useful herein comprises those carboxyl compounds wherein the carboxyl substituent is on a ring hydrocarbyl unit, i.e., secondary soaps of the formula $R^5$–$R^6$—COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

A further class of alkyl carboxylates comprises secondary carboxyl compounds of the formula $CH_3(CHR)_k$—$(CH_2)_m$—$(CHR)_n$—$CH(COOM)(CHR)_o$—$(CH_2)_p$—$(CHR)_q$—$CH_3$, wherein each R is $C_1$–$C_4$ alkyl, wherein k, n, o, q are integers in the range of 0–8, provided that the total number of carbon atoms (including the carboxylate) is in the range of 10 to 18.

In each of the above formulas M can be any suitable, especially water-solubilizing, counterion, e.g., H, alkali metal, alkaline earth metal, ammonium, alkanolammonium, di- and tri-alkanolammonium, and $C_1$–$C_5$ alkyl substituted ammonium. Sodium is convenient, as is diethanolammonium.

Preferred alkyl carboxylates for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid, 2-pentyl-1-heptanoic acid and isopentadecanoic acid.

According to the present invention the compositions comprise from 0.1% to 20%, preferably from 0.5% to 10% of said branched alkyl carboxylate.

Non bridged Polyhydroxy fatty acid amide

According to the present invention the non bridged polyhydroxy fatty acid amides suitable for use herein are according to the formula:

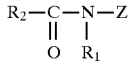

wherein $R_1$ is H, a $C_1$–$C_8$ hydrocarbyl, 2-hydroxy ethyl, 2-hydroxy propyl or mixtures thereof, preferably a $C_1$–$C_4$ alkyl, more preferably a $C_1$ or $C_2$ alkyl, most preferably a $C_1$, and $R_2$ is a $C_1$–$C_{21}$ hydrocarbyl, preferably straight chain $C_7$–$C_{19}$ alkyl or alkenyl, most preferably straight chain $C_{10}$–$C_{18}$ alkyl or alkenyl or mixtures thereof; and Z is a polyhydrocarbyl having a linear hydrocarbyl chain with at least 2 hydroxyl groups directly connected to the chain or an alkoxylated derivative thereof. Z is preferably derived from a reducing sugar in reductive amination reaction; more preferably Z is a glycityl. Suitable reducing sugars include glucose, fructose, maltose, lactose, galactose, mannose and xylose. As raw materials high dextrose corn syrup, high fructose corn syrup and high maltose corn syrup can be utilised as well as individual sugars listed above. It should be understood that these corn syrups may yield a mixture of sugar components for Z. Z is preferably selected from the group consisting of —$CH_2$(CHOH)n$CH_2$OH, —CH($CH_2$OH)—(CHOH)n-1-$CH_2$OH, or —$CH_2$—$(CHOH)_2$(CHOR')(CHOH)—$CH_2$OH and alkoxylated derivatives thereof, wherein n is an integer from 3 to 5 inclusive and R' is hydrogen or a cyclic or aliphatic monosaccharide. Most preferred are the glycityls wherein n is 4, particularly $CH_2(CHOH)_4CH_2OH$.

According to the formula $R_1$ can be for example, N-methyl , N-ethyl, N-propyl, N-isopropyl, N-butyl, N-2-hydroxy ethyl, or N-2-hydroxy propyl. $R_5$—CO—N< can be for example cocamide, stearimide, oleamide, lauramide, myristamide, capricamide, palmitamide, talloamide etc. Z can be 1-deoxyglycityl, 2-deoxyfructityl, 1-deoxymaltityl, 1-deoxylactityl, 1-deoxygalactityl, 1-doexymannityl, 1-deoxymaltotriotityl, etc. According to the present invention the compositions may comprise from 0.1% to 30%, preferably from 1% to 20%, most preferably from 3% to 10% of said polyhydroxy fatty acid amide.

Betaine surfactant

According to the present invention the betaines useful herein are those compounds having the formula $R(R^1)_2N^+R^2COO^-$wherein R is a $C_6$–$C_{18}$ hydrocarbyl group, preferably a $C_{10}$–$C_{16}$ alkyl group or $C_{10-16}$ acylamido alkyl group, each $R^1$ is typically $C_1$–$C_3$ alkyl, preferably methyl, and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethyl-betaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines.

The complex betaines suitable for use herein have the formula:

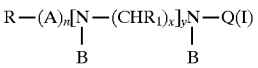

wherein R is a hydrocarbon group having from 7 to 22 carbon atoms, preferably 12 to 14 carbon atoms, A is the group (C(O)), n is 0 or 1, $R_1$ is hydrogen or a lower alkyl group, x is 2 or 3, y is an integer of 0 to 4, Q is the group —$R_2$COOM wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

According to the present invention the composition may comprise from 0.1% to 10%, preferably from 0.1% to 5% of said betaines.

According to the present invention the sudsing performance of said liquid dishwashing detergent composition can be improved by the addition of a bridged polyhydroxy fatty acid amide. The bridged polyhydroxy fatty acid amide has the formula:

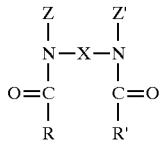

wherein: X is a bridging group having from about 2 to about 200 atoms; Z and Z' are the same or different alcohol-containing moieties having two or more hydroxyl groups (e.g., glycerol, and units derived from reducing sugars such as glucose, maltose and the like), or either one (but not both) of Z or Z' is hydrogen; and R and R' are the same or different hydrocarbyl moieties having from about 1 to about 13 carbon atoms and can be saturated, branched or unsaturated (e.g., oleoyl) and mixtures thereof.

Preferred X groups are selected from substituted or unsubstituted, branched or linear alkyl, ether alkyl, amino alkyl, or amido alkyl moieties having from about 2 to about 15 carbon atoms. Preferred alkyl moieties are unsubstituted, linear alkyl moieties having the formula $—(CH_2)_n—$, wherein n is an integer from 2 to about 15, preferably from 2 to about 10, and most preferably from 2 to about 6; and also unsubstituted, branched alkyl moieties having from 3 to about 15 carbon atoms, preferably from 3 to about 10 carbon atoms, and most preferably from 3 to about 6 carbon atoms. Most preferred are ethylene and propylene (branched or linear) alkyl moieties. Also preferred are unsubstituted, branched or linear ether alkyl moieties having the formula $—R^2—(O—R^2)_m—$, wherein each $R^2$ is independently selected from $C_2$–$C_8$ branched or linear alkyl and/or aryl moieties (preferably ethyl, propyl or combinations thereof) and m is an integer from 1 to about 5. X may also be unsubstituted, branched or linear amino and/or amido alkyl moieties having the formula $—R^2—(N(R^3)—R^2)_m—$, wherein each $R^2$ is independently selected from $C_2$–$C_8$ branched or linear alkyl and/or aryl moieties (preferably ethyl, propyl or combinations thereof), m is an integer from 1 to about 5, and $R^3$ is selected from hydrogen, $C_1$–$C_5$ alkyl, and $—C(O)R^4—$, wherein $R^4$ is $C_1$–$C_{21}$ alkyl, including —C(O)R. The X moiety may be derived from commercially available amine compounds such as, for example, Jeffamines® (supplied by Texaco) such as JED600, JEDR148, JEDR192, JED230, JED2000, J-D230 and J-D400.

Preferred X moieties therefore include: $—(CH_2)_2—$, $—(CH_2)_3—$, $—(CH_2)_4—$, $—(CH_2)_5—$, $—(CH_2)_6—$, $—CH_2CH(CH_3)(CH_2)_3—$, $—(CH_2)_2—O—(CH_2)_2—$, $—(CH_2)_3—O—(CH_2)_3—$, $—(CH_2)_2—O—(CH_2)_3—$, $—(CH_2)_2—O—(CH_2)_2—O—(CH_2)_2—$, $—(CH_2)_3—O—(CH_2)_2—O—(CH_2)_3—$, $—(CH_2)_2—O—(CH_2)_3—O—(CH_2)_2—$, $—(CH_2)_2—NH—(CH_2)_2—$, $—(CH_2)_3—NH—(CH_2)_3—$, $—(CH_2)_2—NH—(CH_2)_3—$, $—(CH_2)_2—N(C(O)R)—(CH_2)_2—$, $—(CH_2)_3—N(C(O)R)—(CH_2)_3—$, $—(CH_2)_2—N(C(O)R)—(CH_2)_3—$, $—(CH_2)_2—NH(C_6H_4)NH—(CH_2)_2—$, $—(CH_2)_3—NH(C_6H_4)NH—(CH_2)_3—$, $—(CH_2)_2—NHCH_2(C_6H_4)CH_2NH—(CH_2)_2—$, $—(CH_2)_3—NHCH_2(C_6H_4)CH_2NH—(CH_2)_3—$, etc.

Preferred Z and Z' groups are independently selected from polyhydroxyhydrocarbyl moieties having a linear hydrocarbyl chain with at least 2 hydroxyls (in the case of glycerol) or at least 3 hydroxyls (in the case of other sugars) directly connected to the chain, or an alkoxylated derivative (preferably ethoxylated or propoxylated) thereof. Z and Z' preferably will be derived from a reducing sugar, more preferably Z and/or Z' is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilised as well as the individual sugars listed above. These corn syrups may yield a mix of sugar components for Z and Z'. It should be understood that it is by no means intended to exclude other suitable raw materials. Z and/or Z' preferably will be selected from the group consisting of $—CH_2—(CHOH)_p—CH_2OH$, $—CH(CH_2OH)—(CHOH)_{p-1}—CH_2OH$, $—CH_2—(CHOH)_2(CHOR^1)(CHOH)—CH_2OH$, where p is an integer from 1 to 5, inclusive, and $R^1$ is H or a cyclic mono- or polysaccharide, and alkoxylated derivatives thereof. Most preferred are glycityls wherein p is 4, particularly $—CH_2—(CHOH)_4—CH_2OH$.

Preferred R and R' groups are independently selected from $C_3$–$C_{21}$ hydrocarbyl moieties, preferably straight or branched chain $C_3$–$C_{13}$ alkyl or alkenyl, more preferably straight chain $C_5$–$C_{11}$ alkyl or alkenyl, most preferably straight chain $C_5$–$C_9$ alkyl or alkenyl, or mixtures thereof. R—CO—N< and/or R'—CO—N< can be, for example, cocamide, stearamide, oleamide, lauramide, myristamide, capricamide, palmitamide, tallowamide, etc.

Examples of such compounds therefore include, but are not limited to:

$CH_3(CH_2)_6C(O)N[CH_2(CHOH)_4CH_2OH]—(CH_2)_2—[CH_2(CHOH)_4CH_2OH]NC(O)(CH_2)_6CH_3$;

$CH_3(CH_2)_8C(O)N[CH_2(CHOH)_4CH_2OH]—(CH_2)_2—[CH_2(CHOH)_4CH_2OH]NC(O)(CH_2)_8CH_3$;

$CH_3(CH_2)_{10}C(O)N[CH_2(CHOH)_4CH_2OH]—(CH_2)_2—[CH_2(CHOH)_4CH_2OH]NC(O)(CH_2)_{10}CH_3$;

$CH_3(CH_2)_8C(O)N[CH_2(CHOH)_4CH_2OH]—(CH_2)_2—O—(CH_2)_2—O—(CH_2)_2—[CH_2(CHOH)_4CH_2OH]NC(O)(CH_2)_8CH_3$;

$CH_3(CH_2)_8C(O)N[CH_2(CHOH)_4CH_2OH]—CH_2CH(CH_3)(CH_2)_3—[CH_2(CHOH)_4CH_2OH]NC(O)(CH_2)_8CH_3$;

$CH_3(CH_2)_8C(O)N[CH_2(CHOH)_4CH_2OH]—(CH_2)_3—O—(CH_2)_2—O—(CH_2)_3—[CH_2(CHOH)_4CH_2OH]NC(O)(CH_2)_8CH_3$;

$CH_3(CH_2)_3CH(CH_2CH_3)C(O)N[CH_2(CHOH)_4CH_2OH]—(CH_2)_2—[CH_2(CHOH)_4CH_2OH]NC(O)CH(CH_2CH_3)(CH_2)_3CH_3$;

$CH_3(CH_2)_6C(O)N[CH_2(CHOH)_4CH_2OH]—(CH_2)_3—O—(CH_2)_2—O—(CH_2)_3—[CH_2(CHOH)_4CH_2OH]NC(O)(CH_2)_6CH_3$;

$CH_3(CH_2)_4C(O)N[CH_2(CHOH)_4CH_2OH]—(CH_2)_3—O—(CH_2)_2—O—(CH_2)_3—[CH_2(CHOH)_4CH_2OH]NC(O)(CH_2)_8CH_3$;

$C_6H_5C(O)N[CH_2(CHOH)_4CH_2OH]—(CH_2)_3—O—(CH_2)_2—O—(CH_2)_3—[CH_2(CHOH)_4CH_2OH]NC(O)C_6H_5$;

$CH_3(CH_2)_4C(O)N[CH_2(CHOH)_4CH_2OH]—(CH_2)_2—[CH_2(CHOH)_4CH_2OH]NC(O)(CH_2)_8CH_3$.

These compounds can be readily synthesised from the following disugar diamines: $HN[CH_2(CHOH)_4CH_2OH]—(CH_2)_2—[CH_2(CHOH)_4CH_2OH]NH$; $HN[CH_2(CHOH)_4CH_2OH]—CH_2CH(CH_3)(CH_2)_3—[CH_2(CHOH)_4CH_2OH]NH$; $HN[CH_2(CHOH)_4CH_2OH]—(CH_2)_2—O—(CH_2)_2—O—(CH_2)_2—[CH_2(CHOH)_4CH_2OH]NH$; $HN[CH_2(CHOH)_4CH_2OH]—(CH_2)_3—O—(CH_2)_2—O—(CH_2)_3—[CH_2(CHOH)_4CH_2OH]NH$; and $HN[CH_2(CHOH)_4CH_2OH]—(CH_2)_3—[CH_2(CHOH)_4CH_2OH]NH$.

The compositions according to the present invention comprise from at least 0.05%, preferably from 0.1% to 30%, more preferably from 0.5% to 20%, most preferably from 1% to 10%, of said bridged polyhydroxy fatty acid amide. According to the present invention the composition preferably comprises said bridged polyhydroxy fatty acid amides and said co-surfactant in a ratio of from 1:50 to 50:1, preferably from 1:10 to 10:1, more preferably from 1:5 to 5:1.

According to the present invention the detergent composition comprises a surfactant system, said system may comprise at least one additional surfactant (other than a polyhydroxyfatty acid amide (a) and amine oxide, betaine, non bridged polyhydroxyfatty acid amide or branched alkylcarboxylate (b)), the selected from anionic, nonionic, amphoteric and zwiterionic surfactants and mixtures thereof.

Nonionic surfactant

Suitable nonionic detergent surfactants for use herein include nonionic condensates of alkyl phenols, nonionic ethoxylated alcohols and nonionic fatty acid amides. According to the present invention the compositions may comprise from 0% to 30%, preferably from 0.1% to 25%, more preferably from 0.5% to 20% of said nonionic surfactants.

Nonionic condensates of alkyl phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 12 carbon atoms in either a straight chain or branched chain configuration with the alkylene oxide.

Nonionic ethoxylated alcohol surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol. Most preferred are the condensation products of alcohols having an alkyl group containing from 8 to 14 carbon atoms with from about 6 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.54 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), Neodol™23-3 (the condensation product of $C_{12}$–$C_{13}$ linear alcohol with 3 moles of ethyene oxide) marketed by Shell Chemical Company, Kyro™ EOBN (the condensation product of $C_{13}$–$C_{15}$ alcohol with 9 moles ethylene oxide), marketed by The Procter & Gamble Company, Dobanol 91 marketed by the Shell Chemical Company and Lial 111 marketed by Enichem.

Nonionic EO/PO condensates with propylene glycol

The condensation products of ethylene oxide with a hydrophobic base formed by the condensation of propylene oxide with propylene glycol are suitable for use herein. Examples of compounds of this type include certain of the commercially-available Pluronic™ surfactants, marketed by BASF.

Nonionic EO condensation products with propylene oxide/ethylene diamine adducts

The condensation products of ethylene oxide with the product resulting from the reaction of propylene oxide and ethylenediamine are suitable for use herein. Examples of this type of nonionic surfactant include certain of the commercially available Tetronic™ compounds, marketed by BASF.

Alkylpolysaccharide

According to the present invention the composition may comprise as an optional ingredient, alkylpolysaccharides i.e. nonionic alkylpolysaccharides or the corresponding sulphated polysaccharides and mixtures thereof. Alkylpolysaccharides suitable for use herein are disclosed in U.S. Pat. No. 4,565,647, Llenado, issued Jan. 21, 1986, having a hydrophobic group containing from about 6 to about 30 carbon atoms, preferably from about 11 to about 30, more preferably 11 to 16 carbon atoms and a polysaccharide, e.g., a polyglycoside, hydrophilic group containing from about 1.0 to about 10, preferably from about 1.0 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.)

The intersaccharide bonds can be, e.g., between the one position of the additional saccharide units and the 2-, 3-, 4-, and/or 6-positions on the preceding saccharide units. Optionally, and less desirably, there can be a polyalkyleneoxide chain joining the hydrophobic moiety and the polysaccharide moiety. The preferred alkyleneoxide is ethylene oxide.

Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactoses. Suitable mixtures include coconut alkyl, di-, tri-, tetra-, and pentaglucosides and tallow alkyl tetra-, penta- and hexaglucosides.

The preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 0–3 preferably 2 to 3, t is from 0 to 10, preferably 0, x is from 1.0 to 10, preferably from 1.0 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

According to the present invention the dishwashing compositions comprise from 0.5% to 50%, preferably from 1% to 30%, more preferably from 1.5% to 20% of said alkylpolysaccharide surfactant.

Anionic surfactant

Anionic surfactants suitable for use herein may be essentially any anionic surfactant, including anionic sulphate, sulphonate or carboxylate surfactant.

Anionic sulphate surfactant

The anionic sulphate surfactant may be any organic sulphate surfactant. It is preferably selected from the group consisting of $C_{10}$–$C_{16}$ alkyl sulphate which has been ethoxylated with from about 0.5 to about 20 moles of ethylene oxide per molecule, $C_9$–$C_{17}$ acyl-N—($C_1$–$C_4$ alkyl) glucamine sulphate, $C_9$–$C_{17}$—N—($C_2$–$C_4$ hydroxyalkyl) glucamine sulphate, and mixtures thereof, wherein the $C_9$–$C_{17}$ acyl group is derived from coconut or palm kernel oil, as described in U.S. Pat. No. 2,717,894. More preferably, the anionic sulphate surfactant is a $C_{10}$–$C_{16}$ alkyl sulphate which has been ethoxylated with from about 0.5 to about 12, moles of ethylene oxide per molecule. The $C_{10}$–$C_{16}$ alcohol itself is commercially available. $C_{12}$–$C_{14}$ alkyl sulphate which has been ethoxylated with from about 3 to about 10 moles of ethylene oxide per molecule is also preferred.

Conventional base-catalysed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation. The counterion for the anionic sulphate surfactant component is preferably selected from calcium, sodium, potassium, magnesium, ammonium, or alkanol-ammonium, and mixtures thereof, with calcium and magnesium being preferred for cleaning and sudsing, respectively.

Anionic alkyl ethoxy carboxylate surfactant

Alkyl ethoxy carboxylates suitable for use herein include those with the formula $RO(CH_2CH_2O)x\ CH_2COO—M^+$ wherein R is a $C_{12}$ to $C_{16}$ alkyl group, x ranges from 0 to 10, and the ethoxylate distribution is such that, on a weight basis, the amount of material where x is 0 is less than 20%, preferably less than 15%, most preferably less than 10%, and the amount of material where x is greater than 7, is less than 25%, preferably less than 15%, most preferably less than 10%, the average x is from 2 to 4 when the average R is $C_{13}$ or less, and the average x is from 3 to 6 when the average R is greater than $C_{13}$, and M is a cation, preferably chosen from alkali metal, alkaline earth metal, ammonium, mono-, di-, and tri-ethanolammonium, most preferably from sodium, potassium, ammonium and mixtures thereof with magnesium ions. The preferred alkyl ethoxy carboxylates are those where R is a $C_{12}$ to $C_{14}$ alkyl group.

Anionic alkyl polyethoxy polycarboxylate surfactant

Alkyl polyethoxy polycarboxylate surfactants suitable for use herein include those having the formula:

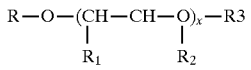

wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof Other anionic surfactants Other anionic surfactants useful for detersive purposes can also be included in the compositions hereof. These can include salts (including, for example, sodium, potassium, ammonium, and substituted ammonium salts such as mono-, di- and triethanolamine salts) of soap, fatty oleyl glycerol sulphates, alkyl phenol ethylene oxide ether sulphates, alkyl phosphates, alkyl succinates and sulphosuccinates, monoesters of sulphosuccinate (especially saturated and unsaturated $C_{12}$–$C_{18}$ monoesters) diesters of sulphosuccinate (especially saturated and unsaturated $C_6$–$C_{14}$ diesters), N-acyl $C_{6\text{-}20}$ sarcosinates. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch).

Compositions according to the present invention comprise at least 3%, preferably from 3% to 40%, most preferably from 3% to 30% of said anionic surfactants.

Amphoteric surfactant

Suitable amphoteric surfactants for use herein include the alkyl amphocarboxylic acids of the formula:

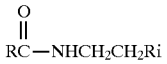

wherein R is a $C_8$–$C_{18}$ alkyl group, and $R_i$ is of the general formula:

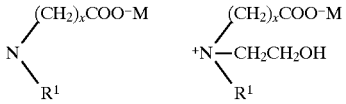

wherein $R^1$ is a $(CH_2)_xCOOM$ or $CH_2CH_2OH$, and x is 1 or 2 and M is preferably chosen from alkali metal, alkaline earth metal, ammonium, mono-, di-, and triethanolammonium, most preferably from sodium, potassium, ammonium and mixtures thereof with magnesium ions. The preferred R alkyl chain length is a $C_{10}$ to $C_{14}$ alkyl group. A preferred amphocarboxylic acid is produced from fatty imidazolines wherein the dicarboxylic acid functionality of the amphodicarboxylic acid is diacetic acid and/or dipropionic acid. A suitable example of an alkyl amphodicarboxylic acid for use herein ins the amphoteric surfactant Miranol(TM) C2M Conc. manufactured by Miranol, Inc., Dayton, N.J.

In addition to the $C_{16}$ to $C_{18}$ amine oxides of the present invention, the detergent composition may comprise as optional ingredient other amine oxides according to the formula:

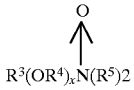

wherein $R^3$ is selected from an alkyl, hydroxyalkyl, acylamidopropyl and alkyl phenyl group, or mixtures thereof, containing from 8 to 26 carbon atoms, preferably 8 to 16 carbon atoms; $R^4$ is an alkylene or hydroxyalkylene group containing from 2 to 3 carbon atoms, preferably 2 carbon atoms, or mixtures thereof; x is from 0 to 3, preferably 0; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$–$C_{14}$ alkyl dimethyl amine oxides and $C_8$–$C_{12}$ alkoxy ethyl dihydroxyethyl amine oxides. Examples of such materials include diethyldecylamine oxide, bis-(2-hydroxyethyl) dodecylamine oxide, dimethyldodecylamine oxide, dipropyltetradecylamine oxide, dodecylamidopropyl dimethylamine oxide and dimethyl-2-hydroxyoctadecylamine oxide. Preferred are $C_{10}$–$C_{14}$ alkyl dimethylamine oxide, and $C_{10-14}$ acylamido alkyl dimethylamine oxide.

According to the present invention the detergent composition may comprise from 0% to 20%, preferably from 1% to 10% of said amine oxide.

Zwitterionic surfactant

Zwitterionic surfactants can also be incorporated into the detergent compositions herein.

Sultaines

The sultaines useful in the present invention are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group.

Hydrotropes A hydrotrope is typically added to the compositions of the present invention, and may be present at levels of from 0% to 40%, preferably from 1% to 15%, by weight.

Useful hydrotropes include sodium, potassium, calcium and ammonium salts of xylene sulphonate, toluene sulphonate and cumene sulphonate and mixtures thereof. Other compounds useful as hydrotropes herein include polycarboxylates and urea. Some polycarboxylates have calcium chelating properties as well as hydrotropic properties.

An example of a commercially available alkylpolyethoxy polycarboxylate which can be employed herein is POLY-TERGENT C, Olin Corporation, Cheshire, Conn., USA.

Another compound useful as a hydrotrope is alkyl amphodicarboxylic acid of the generic formula:

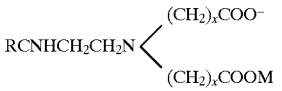

wherein R is a $C_8$ to $C_{18}$ alkyl group, x is from 1 to 2, M is preferably chosen from alkali metal, alkaline earth metal, ammonium, mono-, di-, and tri-ethanolammonium, most preferably from sodium, potassium, ammonium, and mixtures thereof with magnesium ions. The preferred alkyl chain length (R) is a $C_{10}$ to $C_{14}$ alkyl group and the dicarboxylic acid functionally is diacetic acid and/or dipropionic acid.

A suitable example of an alkyl amphodicarboxylic acid is the amphoteric surfactant Miranol R 2CM Conc. manufactured by Miranol, Inc., Dayton, N.J., USA.

Organic solvent

The compositions of the invention will most preferably contain an organic solvent system present at levels of from 1% to 30% by weight, preferably from 1% to 20% by weight, more preferably form 2% to 15% by weight of the composition. The organic solvent system may be a mono, or mixed solvent system; but is preferably in mixed solvent system. Preferably, at least the major component of the solvent system is of low volatility. Suitable organic solvents for use herein have the general formula:

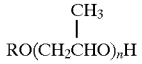

wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1-n-butoxypropane-2-ol (n=1); and 1(2-n-butoxy-1-methylethoxy)propane-2-ol (n=2), and mixtures thereof.

Other solvents useful herein include the water soluble CARBITOL or CELLOSOLVE solvents. These solvents are compounds of the 2-(2-alkoxyethoxy)ethanol class wherein the alkoxy group is derived from ethyl, propyl or butyl.

Other suitable solvents are benzyl alcohol, and diols such as 2-ethyl-1,3-hexanediol and 2,2,4-trimethl-1,3-pentanediol. The low molecular weight, water-soluble, liquid polyethylene glycols are also suitable solvents for use herein.

The alkane mono and diols, especially the $C_1$–$C_6$ alkane mono and diols are suitable for use herein. $C_1$–$C_4$ monohydric alcohols (e.g.: ethanol, propanol, isopropanol, butanol and mixtures thereof) are preferred, with ethanol particularly preferred. The C1–C4 dihydric alcohols, including propylene glycol, are also preferred.

Thickening agents

The compositions according to the present invention may additionally comprise thickening agents, such as polyquaternium cellulose cationic polymer, for example Quatrisoft® available from the Americhol Corporation.

Calcium

Compositions according to the present invention may optionally comprise from 0.01% to 3%, more preferably from 0.15% to 0.9% of calcium ions. It has been found that the presence of calcium greatly improves the cleaning of greasy soils for compositions containing polyhydroxy fatty acid amide. This is especially true when the compositions are used in softened water, which contains few divalent ions.

The calcium ions can, for example, be added as a chloride, hydroxide, oxide, formate or acetate, or nitrate salt, xylene sulphonate, cumene sulphonate and toluene sulphonate. If the anionic surfactants are in the acid form, the calcium can be added as a calcium oxide or calcium hydroxide slurry in water to neutralise the acid.

The calcium ions may be present in the compositions as salts. The amount of calcium ions present in compositions of the invention may be dependent upon the amount of total anionic surfactant present herein. The molar ratio of calcium ions to total anionic surfactant is preferably from 1:0.1 to 1:25 more preferably from 1:2 to 1:10, for compositions of the invention.

Calcium stabilising agent

In order to provide good product stability, and in particular to prevent the precipitation of insoluble calcium salts malic, maleic or acetic acid, or their salts, or certain lime soap dispersant compounds may be added to the composition of the present invention comprising calcium. Where calcium is present, malic, maleic or acetic acid, or their salts can be added at levels of from 0.05% to 10% of the composition and a molar ratio with calcium of from 10:1 to 1:10.

Magnesium

From 0.01% to 3%, most preferably from 0.15% to 2%, by weight, of magnesium ions are preferably added to the liquid detergent compositions of the invention for improved product stability, as well as improved sudsing.

If the anionic surfactants are in the acid form, then the magnesium can be added by neutralisation of the acid with a magnesium oxide or magnesium hydroxide slurry in water. Calcium can be treated similarly. This technique minimises the addition of chloride ions, which reduces corrosive properties. The neutralised surfactant salts and the hydrotrope are then added to the final mixing tank and any optional ingredients are added before adjusting the pH.

pH of the compositions

The compositions according to the present invention formulated for use in manual dishwashing applications are preferably formulated to have a pH at 20° C. of from 3 to 12, preferably from 6 to 9, most preferably from 6.5 to 8.5.

In another aspect of the present invention the composition may be formulated for use as in pre-treatment applications whereby the composition is applied in essentially the concentrated form onto the dishes. Preferably the composition is allowed to remain on the dishes for a period of time. Compositions for use in such applications preferably have a pH of from 3 to 14, more preferably from 3 to 5 or greater than 8.

Liquid compositions

According to the present invention the detergent compositions are liquid detergent compositions. In one preferred embodiment of the present invention the compositions are high active formulations such that said compositions comprise 75% to 50% by weight, preferably from 70% to 55% by weight, most preferably from 65% to 55% by weight of a liquid carrier, e.g., water, preferably a mixture of water and a C1–C4 monohydric alcohol (e.g., ethanol, propanol, isopropanol, butanol, and mixtures thereof), with ethanol being the preferred monohydric alcohol or a mixture of water and $C_1$–$C_4$ dihydric alcohol (e.g.: propylene glycol). In another preferred embodiment of the present invention the detergent composition may be in a concentrated form, such that the composition is diluted in water prior to usage.

The bridged poly hydroxy fatty acid amides of the present invention may be prepared by the following method.

EXAMPLE I

Step 1: Reductive Amination

Preparation of $HN[CH_2(CHOH)_4CH_2OH]—(CH_2)_2CH_2(CHOH)_4CH_2OH]NH$

About 375 g (about 20 wt % based on amount of glucose used) of Raney Ni (Grace Raney Nickel 4200) is contained in a 2 gallon reactor (316 stainless steel baffled autoclave with DISPERSIMAX hollow shaft multi-blade impeller) pressurized to about 300 psig with hydrogen at room temperature. The nickel bed is covered with water taking up about 10% of the reactor volume. This is the first reductive amination run on the present load of nickel catalyst. 606.53 g of 50 wt % ethylenediamine solution in water (5.05 moles, 1.00 mole equiv. of ethylenediamine) is maintained in a separate reservoir which is in closed communication with the reactor. The reservoir is pressurized to about 100 psig with nitrogen. 3636.36 g of 55 wt % D-glucose solution in water (11.1 moles, 2.20 mole equiv. of glucose) is maintained in a second separate reservoir which is also in closed communication with the reactor and is also pressurized to about 100 psig with nitrogen.

The ethylenediamine is loaded into the reactor from the reservoir using a high pressure pump. Once all the ethylenediamine is loaded into the reactor, stirring is begun and the reactor heated to 50 deg. C and pressurized to about 500 psig hydrogen.

The glucose solution is then loaded into the reactor from the reservoir using a high pressure pump similar to the amine pump above. However, the pumping rate on the glucose pump can be varied and on this particular run, it is set to load the glucose in about 10 minutes. Once all the glucose is loaded into the reactor, the pressure is boosted to about 1300 psig hydrogen and the temperature raised to 60 deg. C for about 1 hour. The temperature is then raised to 70 deg. C for 10 minutes, 80 deg. C for 10 minutes, 100 deg. C for 10 minutes, and finally 120 deg. C for 5 minutes, while maintaining hydrogen pressure between 1300–1500 psig.

The reactor is then cooled to 70 deg. C and the reaction solution removed from the reactor under hydrogen pressure via an internal dip tube and through a filter in closed communication with the reactor. Filtering under hydrogen pressure allows removal of any nickel particles without nickel dissolution.

Solid product is recovered by evaporation of water. The product purity is approximately 85–90%. Sorbitol is the major impurity at about 10%. The product can be used as is or purified to greater than 99%.

Step 2: Amidation

Preparation of $CH_3(CH_2)_8C(O)N[CH_2(CHOH)_4CH_2OH]—(CH_2)_2—[CH_2(CHOH)_4CH_2OH]NC(O)(CH_2)_8CH_3$ 102.13 g of the disugar diamine product of Step 1 (0.263 moles) is dissolved in a solvent mixture of 295.16 g of water and 272.35 g of acetone. With good mixing, 110.32 g of decanoyl chloride (0.578 moles) is slowly added (approx. 1 drop/second) to the disugar diamine solution while simultaneously adding 10 wt % NaOH solution to maintain pH 9–11 throughout the reaction. Once all decanoyl chloride is added, the pH is adjusted to approximately 10 and the reaction is mixed for one hour.

Solid, crude product is obtained by evaporation of water and acetone. The solid, crude product is dissolved in ethanol and the solution filtered to remove NaCl. The filtrate is then concentrated to obtain solid, salt free, crude product. The product purity is approximately 80–90%. The crude product can be used as is.

EXAMPLE II

Step 1: Reductive Amination

Preparation of $HN[CH_2(CHOH)_4CH_2OH]—(CH_2)_3—O—(CH_2)_2—O—(CH_2)_3—[CH_2(CHOH)_4CH_2OH]NH$:

1,2-Bis(3-aminopropoxy)ethane and glucose are reacted in the same manner as Step 1 of Example I for Reductive amination to produce the disugar diamine product.

Step 2: Amidation

Preparation of $CH_3(CH_2)_6C(O)N[CH_2(CHOH)_4CH_2OH]—(CH_2)_3—O—(CH_2)_2—O—(CH_2)_3—[CH_2(CHOH)_4CH_2OH]NC(O)(CH_2)_6CH_3$ 312.12 g of the disugar diamine product of Step 1 (0.618 moles) is melted under nitrogen and then dehydrated under vacuum. With good mixing, 27.35 g of propylene glycol and 234.92 g of methyl octanoate (1.48 moles), which are preheated to 130 deg. C, are added to the melted diamine. The reaction temperature is adjusted to 130 deg. C and 14.0 g of 25 wt % sodium methoxide (0.0618 moles) solution in methanol is added. Once reaction is homogeneous, the temperature is dropped to 90–100 deg. C and the reaction methanol is refluxed for 1–2 hours. After refluxing, the methanol is distilled out with the last remaining methanol being pulled out under vacuum for two hours. The reaction mix is poured out and allowed to cool to room temperature.

The crude product is a viscous liquid with a purity of 70–80% which can be used as is or purified by column chromatography.

Examples 1–4

The following compositions in accord with the invention were prepared.

| | % By Weight of the Total Composition | | | |
|---|---|---|---|---|
| | 1 | 2 | 3 | 4 |
| C12–C14 alkyl ethoxy sulphate | 9.30 | 9.30 | 15 | 9.30 |
| C12 alkyl N-methyl glucamide | 7 | 4 | — | 7 |
| C12–C14 alkyl carboxylate | 1 | — | 3.5 | 3.5 |
| C12–C14 alkyl dimethyl betain | — | 1.55 | 2 | 1.55 |
| C12/14 dimethyl amine oxide | 4 | 1.16 | 5 | 1.16 |
| C16 dimethyl amine oxide | 3.9 | 7.75 | 5 | — |
| Amide (from Ex. II) | 3.9 | 3.9 | 5 | 7.75 |
| C11 alkyl ethoxylate (av. 9) | 1.0 | 6.0 | 4 | 3.5 |
| Ca++ | 0.14 | 0.14 | — | 0.3 |
| Mg++ | 0.47 | 0.47 | 0.6 | 0.3 |
| Sodium cumene sulphonate | 3.7 | 3.7 | 3.7 | — |
| EtOH | 6 | 7 | 5 | 6 |

What is claimed is:

1. A liquid dishwashing detergent composition comprising:

a) from 0.1% to 30%, by weight of the composition, of a bridged polyhydroxy fatty acid amide according to the formula:

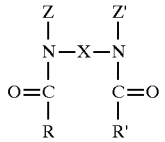

wherein X is selected from the group consisting of substituted or unsubstituted, branched or linear alkyl, ether alkyl, amino alkyl, and amido alkyl moieties having from 2 to 15 carbon atoms; Z and Z' are the same or different alcohol-containing moieties having two or more hydroxyl groups, or one of Z or Z' is hydrogen; and R and R' are the same or different hydrocarbyl moieties having from 1 to 13 carbon atoms and can be saturated, branched or unsaturated or mixtures thereof; and b) a co-surfactant selected from the group consisting of $C_{16}$ to $C_{18}$ amine oxides, $C_{12}$–$C_{14}$ alkyl dimethyl betaines, alkylcarboxylates, $C_{10}$–$C_{18}$ N-alkyl polyhydroxy fatty acid amides, and mixtures thereof.

2. A liquid dishwashing detergent composition according to claim 1, wherein in component (a), Z and Z' are independently selected from the group consisting of polyhydroxyhydrocarbyl moieties having a linear hydrocarbyl chain with at least 2 hydroxyl groups directly connected to the chain.

3. A liquid dishwashing detergent composition according to claim 1 wherein X is selected from the group consisting of unsubstituted, linear alkyl moieties having the formula $—(CH_2)_n—$, wherein n is an integer from 2 to 15, unsubstituted, branched alkyl moieties having from 3 to 15 carbon atoms, unsubstituted, branched or linear ether alkyl moieties having the formula $—R^2—(O—R^2)_m—$, wherein each $R^2$ is independently selected from $C_2$–$C_8$ branched or linear alkyl or aryl moieties and m is an integer from 1 to about 5, and unsubstituted, branched or linear amino or amido alkyl moieties having the formula $—R^2—(N(R^3)—R^2)_m—$, wherein each $R^2$ is independently selected from the group consisting of $C_2$—$C_8$ branched, linear alkyl and aryl moieties, m is an integer from 1 to about 5, $R^3$ is selected from the group consisting of hydrogen, $C_1$—$C_5$ alkyl, and $—C(O)R^4—$, wherein $R^4$ is $C_1$—$C_{21}$, alkyl; Z and Z' are independently selected from the group consisting of $—CH_2—(CHOH)_p—CH_2OH$ $[—CH_2—(CHOH)—_p—CH_2OH]$, $—CH(CH_2OH)—(CHOH)_{p-1}—CH_2OH$, and $—CH_2—(CHOH)_2(CHOR^1)(CHOH)—CH_2OH$, where p is an integer from 1 to 5, inclusive, and $R^1$ is H or a cyclic mono- or polysaccharide, and alkoxylated derivatives thereof; and R and R' are independently selected from the group consisting of straight or branched chain $C_3$–$C_{13}$ alkyl or alkenyl moieties.

4. A liquid dishwashing detergent composition according to claim 2, wherein X is selected from the group consisting of $—(CH_2)_2—$, $—(CH_2)_3—$, $—(CH_2)_4—$, $—(CH_2)_5—$, $—(CH_2)_6—$, $—CH_2CH(CH_3)(CH_2)_3—$, $—(CH_2)_2—O—(CH_2)_2—$, $—(CH_2)_3—O—(CH_2)_3—$, $—(CH_2)_2—O—(CH_2)_3—$, $—(CH_2)_2—O—(CH_2)_2—O—(CH_2)_2—$, $—(CH_2)_3—O—(CH_2)_2—O—(CH_2)_3—$, $—(CH_2)_2—O—(CH_2)_3—O—(CH_2)_2—$, $—(CH_2)_2—NH—(CH_2)_2—$, $—(CH_2)_3—NH—(CH_2)_3—$, $—(CH_2)_2—NH—(CH_2)_3—$, $—(CH_2)_2—N(C(O)R)—(CH_2)_2—$, $—(CH_2)_3—N(C(O)R)—(CH_2)_3—$, $—(CH_2)_2—N(C(O)R)—(CH_2)_3—$, $—(CH_2)_2—NH(C_6H_4)NH—(CH_2)_2—$, $—(CH_2)_3—NH(C_6H_4)NH—(CH_2)_3—$, $—(CH_2)_2—NHCH_2(C_6H_4)CH_2NH—(CH_2)_3—$, and $—(CH_2)_{2-NHCH2}(C_6H_4)CH_2NH—(CH_2)_3—$;

Z and Z' are independently selected from the group consisting of $—CH_2—(CHOH)_{4-}CH_2OH$; and R and R' are independently selected from the group consisting of straight chain $C_5$–$C_{11}$ alkyl and alkenyl moieties.

5. A liquid dishwashing detergent composition according to claim 1, comprising from 0.5% to 20% by weight of said bridged polyhydroxy fatty acid amide compound (a).

6. A liquid dishwashing composition according to claim 5, comprising from 1% to 40% by weight of said co-surfactant (b) or mixtures thereof.

7. A liquid dishwashing detergent composition according to claim 6, wherein said co-surfactant (b) is a $C_{16}$ amine oxide.

8. A liquid dishwashing detergent composition according to claim 1, wherein the pH of the composition at 20° C. is in the range of from 3 to 5.

9. A liquid dishwashing detergent composition according to claim 1, further comprising, by weight, from 0.01% to 3% by weight calcium ions and from 0.05% to 10% by weight of a calcium stabilizing system selected from the group consisting of malic acid, malic acid salt, maleic acid, maleic acid salt, acetic acid, acetic acid salt, and mixtures thereof.

10. A liquid dishwashing detergent composition according to claim 1, wherein the alkylcarboxylate is selected from the group consisting of:

i) $R^5—R^6—COOM$ wherein $R^5$ is a $C_{7-10}$ alkyl or $C_{7-10}$ alkenyl and $R^6$ is benzene, cyclopentane or cylcohexane;

ii) $R^7CH(R^8)COOM$ wherein $R^7$ is $CH_3(CH_2)_x$ and $R^8$ is $CH_3(CH_2)_y$ wherein x is an integer from 4 to 10, y can be 0 or an integer from 1 to 4, and the sum of (x+y) is from 6 to 14;

iii) $CH_3(CHR^9)_k—(CH_2)_m—(CHR^9)_n—CH(COOM)(CHR^9)_o—(CH_2)_p—(CHR^9)_q—CH_3$ wherein each $R^9$ is $C_{1-4}$ alkyl and k, n, o and q are integers in the range of 0 to 8, provided that the total number of carbon atoms is in the range of 10 to 18; and iv) mixtures thereof.

11. A liquid dishwashing detergent composition comprising, by weight:

from 0.05% to 10% of a calcium stabilizing system selected from the group consisting of malic acid, malic acid salt, maleic acid, maleic acid salt, acetic acid, acetic acid salt, and mixtures thereof; and at least 1% of a surfactant system comprising:

a) a bridged polyhydroxy fatty acid amide according to the formula:

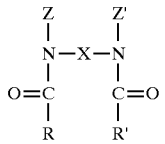

wherein X is selected from the group consisting of substituted or unsubstituted, branched or linear alkyl, ether alkyl, amino alkyl, and amido alkyl moieties having from 2 to 15 carbon atoms; Z and Z' are the same or different alcohol-containing moieties having two or more hydroxyl groups, or one of Z or Z' is hydrogen; and R and R' are the same or different hydrocarbyl moieties having from 1 to 13 carbon atoms and can be saturated, branched or unsaturated or mixtures thereof; and b) a co-surfactant selected from the group consisting of $C_{16}$ to $C_{18}$ amine oxides, $C_{10}$–$C_{16}$ branched alkyl carboxylates, $C_6$–$C_{18}$ betaines, and nonbridged polyhydroxyfatty acid amides according to the formula:

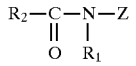

wherein $R_1$ is H, a $C_1$–$C_8$ hydrocarbyl, 2-hydroxy ethyl, 2-hydroxy propyl or mixtures thereof, $R_2$ is a $C_1$–$C_{21}$ hydrocarbyl and Z is a polyhydrocarbyl having a linear hydrocarbyl chain with at least 2 hydroxyl groups directly connected to the chain or an alkoxylated derivative thereof and mixtures thereof.

12. A liquid dishwashing detergent composition according to claim 11, further comprising from 0.01% to 3% calcium ions.

13. A liquid dishwashing detergent composition according to claim 11, wherein the pH of the composition at 20° C. is in the range of from 3 to 6.5.

14. A liquid dishwashing detergent composition according to claim 12, further comprising from 0.01% to 3% magnesium ions.

15. A liquid dishwashing detergent composition according to claim 11, wherein the weight ratio of said bridged polyhydroxy fatty acid amide (a) to said co-surfactant (b) is from 1:50 to 50:1.

16. A liquid dishwashing detergent composition comprising at least 1%, by weight, of a surfactant system comprising:

a) a bridged polyhydroxy fatty acid amide according to the formula:

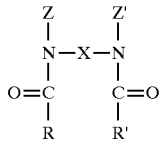

wherein X is selected from the group consisting of substituted or unsubstituted, branched or linear alkyl, ether alkyl, amino alkyl, and amido alkyl moieties having from 2 to 15 carbon atoms; Z and Z' are the same or different alcohol-containing moieties having two or more hydroxyl groups, or one of Z or Z' is hydrogen; and R and R' are the same or different hydrocarbyl moieties having from 1 to 13 carbon atoms and can be saturated, branched or unsaturated or mixtures thereof;

b) a co-surfactant selected from the group consisting of $C_{16}$ to $C_{18}$ amine oxides, $C_{10}$–$C_{18}$ branched alkyl carboxylates, $C_6$–$C_{18}$ betaines, and nonbridged polyhydroxyfatty acid amides according to the formula:

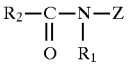

wherein $R_1$ is H, a $C_1$—$C_8$ hydrocarbyl, 2-hydroxy ethyl, 2-hydroxy propyl or mixtures thereof, $R_2$ is a $C_1$—$C_{21}$ hydrocarbyl and Z is a polyhydrocarbyl having a linear hydrocarbyl chain with at least 2 hydroxyl groups directly connected to the chain or an alkoxylated derivative thereof and mixtures thereof;

wherein the pH of the composition at 20° C. is in the range of from 3 to 6.5.

17. A liquid dishwashing detergent composition according to claim 16, further comprising an alkyl amphocarboxylic acid of the formula:

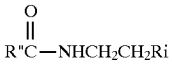

wherein R' is a $C_{8-18}$ alkyl group and Ri has the formula:

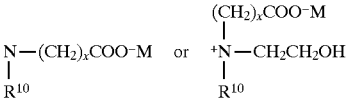

wherein $R^{10}$ is a $(CH_2)_xCOOM$ or $CH_2CH_2OH$, x is 1 or 2, and M is an alkali metal, alkaline earth metal, ammonium, monoethanolammonium, diethanolammonium, or triethanolammonium.

18. A liquid dishwashing detergent composition according to claim 16 comprising:

a) from 0.1% to 30%, by weight, of the bridged polyhydroxy fatty acid amide; and b) from 1% to 40%, by weight, of the co-surfactant;

wherein the ratio of bridged polyhydroxy fatty acid amide to co-surfactant is in a ratio of from 1:50 to 50:1 and the pH of the composition at 20° C. is in the range of from 3 to 5.

19. A liquid dishwashing detergent composition according to claim 16, wherein said co-surfactant (b) is a non bridged polyhydroxy fatty acid amide wherein $R_2$ is a $C_{10}$–$C_{18}$ alkyl group.

* * * * *